US006598965B1

(12) United States Patent
Lund et al.

(10) Patent No.: US 6,598,965 B1
(45) Date of Patent: Jul. 29, 2003

(54) FIXER USAGE GENERATION TECHNIQUE FOR INKJET PRINTERS

(75) Inventors: Mark D. Lund, Vancouver, WA (US); Ngoc-Diep T. Nguyen, Vancouver, WA (US); Charles S. Woodruff, Brush Prairie, WA (US)

(73) Assignee: Hewlett-Packard Company, L.P., Houston, TX (US)

( * ) Notice: Subject to any disclaimer, the term of this patent is extended or adjusted under 35 U.S.C. 154(b) by 0 days.

(21) Appl. No.: 09/452,279

(22) Filed: Nov. 30, 1999

(51) Int. Cl.[7] ..... B41J 2/17
(52) U.S. Cl. ..... 347/96
(58) Field of Search ..... 347/96, 95, 44, 347/45, 57, 101, 102; 400/61, 70, 76

(56) References Cited

U.S. PATENT DOCUMENTS 4,562,445 A * 12/1985 Rich ..... 347/9
5,757,390 A * 5/1998 Gragg et al. ..... 347/7
5,984,454 A * 11/1999 Takahashi et al. ..... 347/43
6,113,290 A * 9/2000 Tanaka et al. ..... 400/61
6,132,021 A * 10/2000 Smith et al. ..... 347/6
6,193,361 B1 * 2/2001 Wen ..... 347/84
6,213,584 B1 * 4/2001 Noyes ..... 347/40
6,474,778 B1 * 11/2002 Koitabashi et al. ..... 347/43

* cited by examiner

*Primary Examiner*—Lamson Nguyen
*Assistant Examiner*—K. Feggins

(57) ABSTRACT

Disclosed is a system in an inkjet printer for determining the amount of a fixer to be applied to a medium. The system comprises a fixer generation circuit where the fixer generation circuit determines an amount of a fixer to be applied to a dot location on a medium based on an amount of ink to be applied to the dot location. A bloom encoder circuit is also disclosed for identifying amounts of fixer to be deposited adjacent to dot locations containing ink.

29 Claims, 7 Drawing Sheets

| | | | | | | | | | | | | | | | |
|---|---|---|---|---|---|---|---|---|---|---|---|---|---|---|---|
| | | | | | | | | | | | | | | | |
| | | | | | | | | | | | | | | | |
| | | | | | | | | | | | | | | | |
| | | | | 1 | 2 | 3 | 3 | 3 | 3 | 2 | 1 | | | | |
| | | | | 1 | 2 | 3 | 3 | 3 | 3 | 2 | 1 | | | | |
| | | | | | | | 3 | 3 | | | | | | | |
| | | | | | | | 3 | 3 | | | | | | | |
| | | | | | | | 3 | 3 | | | | | | | |
| | | | | | | | 3 | 3 | | | | | | | |
| | | | | | | | 3 | 3 | | | | | | | |
| | | | | | | | 2 | 2 | | | | | | | |
| | | | | | | | 1 | 1 | | | | | | | |
| | | | | | | | | | | | | | | | |
| | | | | | | | | | | | | | | | |
| | | | | | | | | | | | | | | | |
| | | | | | | | | | | | | | | | |

FIG. 5A

| | | | | | | | | | | | | | | | |
|---|---|---|---|---|---|---|---|---|---|---|---|---|---|---|---|
| | | | | | | | | | | | | | | | |
| | | B | B | B | B | B | B | B | B | B | B | B | B | | |
| | | B | A | A | A | A | A | A | A | A | A | A | B | | |
| | | B | A | 1 | 2 | 3 | 3 | 3 | 3 | 2 | 1 | A | B | | |
| | | B | A | 1 | 2 | 3 | 3 | 3 | 3 | 2 | 1 | A | B | | |
| | | B | A | A | A | A | 3 | 3 | A | A | A | A | B | | |
| | | B | B | B | B | A | 3 | 3 | A | B | B | B | B | | |
| | | | | | B | A | 3 | 3 | A | B | | | | | |
| | | | | | B | A | 3 | 3 | A | B | | | | | |
| | | | | | B | A | 3 | 3 | A | B | | | | | |
| | | | | | B | A | 2 | 2 | A | B | | | | | |
| | | | | | B | A | 1 | 1 | A | B | | | | | |
| | | | | | B | A | A | A | A | B | | | | | |
| | | | | | B | B | B | B | B | B | | | | | |
| | | | | | | | | | | | | | | | |
| | | | | | | | | | | | | | | | |

FIG. 5B

| | | | |
|---|---|---|---|
| 0 | 1 | 0 | 1 |
| 1 | 0 | 1 | 0 |
| 0 | 1 | 0 | 1 |
| 1 | 0 | 1 | 0 |

628

629

630

| | | | | | | | | | | | | | | | |
|---|---|---|---|---|---|---|---|---|---|---|---|---|---|---|---|
| | | | | | | | | | | | | | | | |
| | | | B | | B | | B | | B | | B | | B | | |
| | | B | | A | | A | | A | | A | | A | | | |
| | | | A | 1 | 2 | 3 | 3 | 3 | 3 | 2 | 1 | | B | | |
| | | B | | 1 | 2 | 3 | 3 | 3 | 3 | 2 | 1 | A | | | |
| | | | A | | A | | 3 | 3 | A | | A | | B | | |
| | | B | | B | | A | 3 | 3 | | B | | B | | | |
| | | | | | B | | 3 | 3 | A | | | | | | |
| | | | | | | A | 3 | 3 | | B | | | | | |
| | | | | | B | | 3 | 3 | A | | | | | | |
| | | | | | | A | 2 | 2 | | B | | | | | |
| | | | | | B | | 1 | 1 | A | | | | | | |
| | | | | | | A | | A | | B | | | | | |
| | | | | | B | | B | | B | | | | | | |
| | | | | | | | | | | | | | | | |
| | | | | | | | | | | | | | | | |

FIG. 5D

FIXER USAGE GENERATION TECHNIQUE FOR INKJET PRINTERS

BACKGROUND OF THE INVENTION

1. Field of the Invention

The present invention relates generally to inkjet printers and more specifically to a technique for controlling the application of fixer to a medium.

2. Background of the Invention

An inkjet printer forms a printed image by printing a pattern of individual dots on a printing medium. Inkjet printers print dots by ejecting very small drops of ink onto the print medium and typically include a movable carriage that supports one or more printheads each having ink ejecting nozzles. The carriage traverses over the surface of the print medium, and the nozzles eject drops of ink at appropriate times pursuant to commands of a microcomputer or other controller.

Color thermal inkjet printers commonly employ a plurality of printheads, such as four, mounted in the carriage to produce different colors. Each printhead prints ink of a different primary color, with the commonly used colors being cyan, magenta, yellow, and black. Secondary or shaded colors are formed by depositing multiple drops of different primary color inks onto the same dot location (or nearby locations), with the overprinting of two or more primary colors producing secondary colors according to well established optical principles.

The printhead has an array of precisely formed nozzles attached to a printhead substrate that incorporates an array of firing chambers which receive liquid ink from the ink reservoir. In one type of printhead, each chamber has a thin-film resistor located opposite the nozzle so ink can collect between it and the nozzle. When electric printing pulses heat the resistor, a small portion of the ink vaporizes, causing a drop of ink to be ejected from the chamber. Proper sequencing of the firing resistors causes characters or images to be printed on the paper as the printhead moves across the paper.

Print quality is one of the most important considerations in the color inkjet printer field. Since the image output of an inkjet printer is formed of thousands of individual ink drops, the quality of the image is ultimately dependent upon the quality of each ink drop and the arrangement of the ink drops on the print medium.

One common problem that degrades the quality of the printed image is a lack of edge sharpness. In an ideal environment, ink drops would form a perfect circle of uniform size when applied to a medium. However, it is common for ink drops to bleed or feather into surrounding areas when applied to a medium. If the surrounding area is a non-ink area, then the resulting image will not have a well defined edge. If the surrounding area is another ink drop, then the colors of the two ink drops will combine, producing a different undesirable color. In either case, the quality of the image is seriously degraded.

Several methods have been employed to address this problem. The first method is to use special inks that will either react with each other or with the medium to improve edge sharpness. This method, however, severely restricts the types of inks that can be used in inkjet printing systems. The second method is to use special media. This method is also very restrictive since special media (e.g., specially purchased paper) must be used when printing.

A second common problem that degrades the quality of the printed image arises from slow drying of the ink. For example, after printing of a page is complete, the printer needs to hold onto the page for a predetermined time in order to let the ink dry before depositing the page in an output tray. This places an undesirable limit on how fast consecutive pages can be printed.

A third common problem that degrades the quality of the printed image is poor water fastness. After the ink has dried on its respective medium, it is desirable to maintain the integrity of the image even if a small amount of moisture, such as perspiration from one's hand, is applied to the image. If the image has poor water fastness, the moisture will cause the ink to bleed or run, thereby seriously degrading the image.

These drawbacks have been addressed, in part, by using fixers. Fixers may be a clear solution or may even be dye-based ink printed beneath a pigment-based ink. Fixers allow inks to bond to a medium thereby improving edge sharpness. Fixers also help increase the drying speed of inks and improve water fastness.

Applying fixers to a medium can, however, cause undesirable effects. Applying too much fixer to each dot location can cause the medium to warp or cockle. Using too much fixer also increases the cost of printing a page since excess fixer is being used. On the other hand, using too little fixer can also cause undesirable effects. Too little fixer may not achieve the desired chroma, water fastness, strike through avoidance, and edge sharpness.

What is needed is an improved inkjet printer that applies an optimal amount of fixer in every dot location.

SUMMARY OF THE INVENTION

A system in an inkjet printer for determining the amount of a fixer to be applied to a medium is disclosed. The system receives image data, and a fixer plane generation circuit determines an amount of fixer to be applied to a dot location on a medium.

BRIEF DESCRIPTION OF THE DRAWINGS

FIG. 5*a* illustrates a fixer plane before blooming.

FIG. 5*b* illustrates a fixer plane after blooming.

FIG. 5*d* illustrates a 50% depletion bloom mask and a corresponding fixer plane.

DETAILED DESCRIPTION

Figure 1:
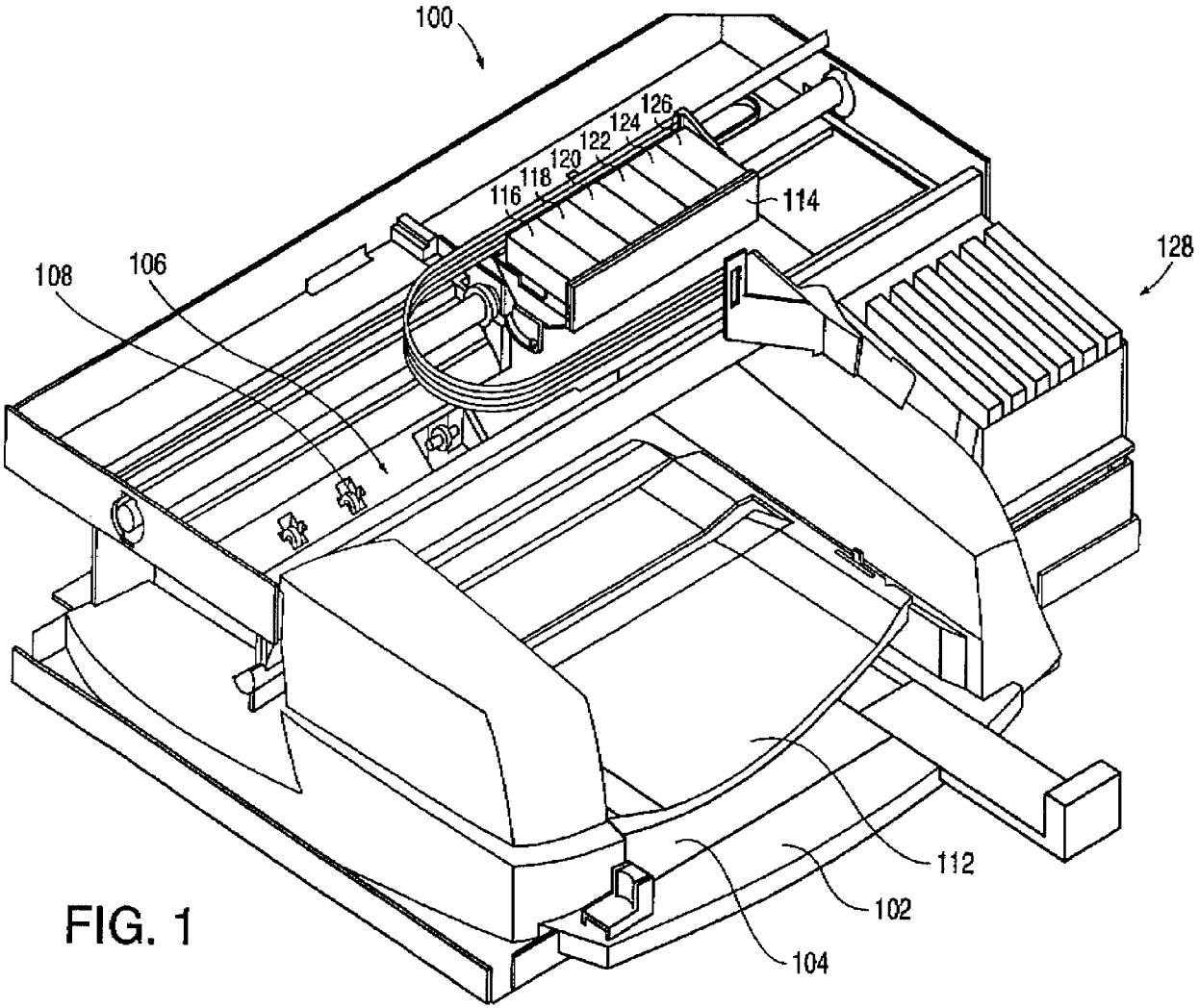
FIG. 1 illustrates one example of an ink jet printer that incorporates the present invention.

FIG. 1 illustrates one example of an inkjet printer 100 that carries out the present invention. Numerous other designs of inkjet printers may also be used while carrying out this invention. More details of an inkjet printer are described in U.S. Pat. No. 5,852,459, issued to Norman Pawlowski et al., incorporated herein by reference.

Inkjet printer 100 includes an input tray 102 containing sheets of paper 104 which are forwarded through a print zone 106, using rollers 108, for being printed upon. Paper 104 is then forwarded to an output tray 112. In one embodiment, a moveable carriage 114 holds print cartridges 116, 118, 120, 122, 124, and 126, which respectively contain fixer, black ink, cyan ink, magenta ink, yellow ink, and fixer. The fixer print cartridges 116 and 126 allow fixer to be underprinted or overprinted in both directions. The print cartridges in FIG. 1 receive ink via tubes from respective ink cartridges 128, but the print cartridges may instead contain a supply of ink.

Fixers are described in U.S. Pat. Nos. 4,694,302 and 5,746,818, both incorporated by reference, and further described in the application entitled Dynamic Adjustment of Under and Over Printing Levels in a Printer, by Brooke Smith et al., Ser. No. 09/329,974, filed on Jun. 10, 1999, assigned to the present assignee and incorporated herein by reference.

Figure 2:
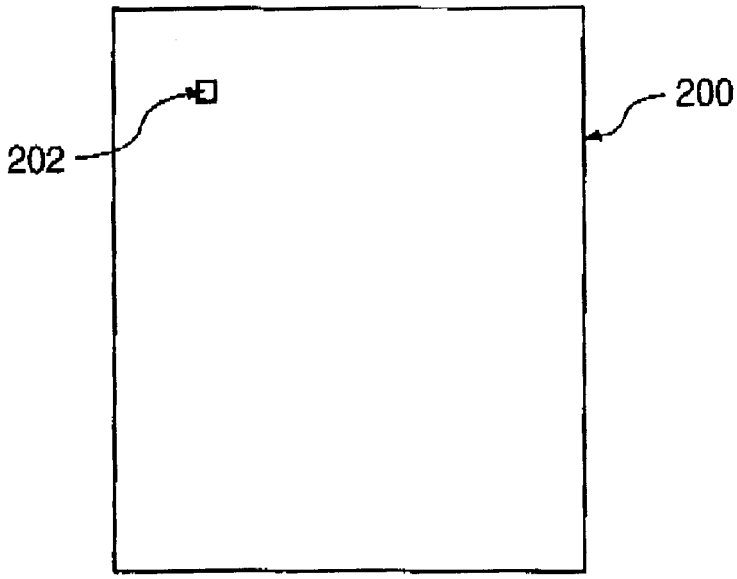
FIG. 2 illustrates a medium.

FIG. 2 illustrates a medium 200 on which the inkjet printer 100 prints an image. The medium 200 can be a sheet of paper, a transparency, or any other medium which is suitable for printing. A small section of the medium 202 is indicated in FIG. 2.

Figure 3:
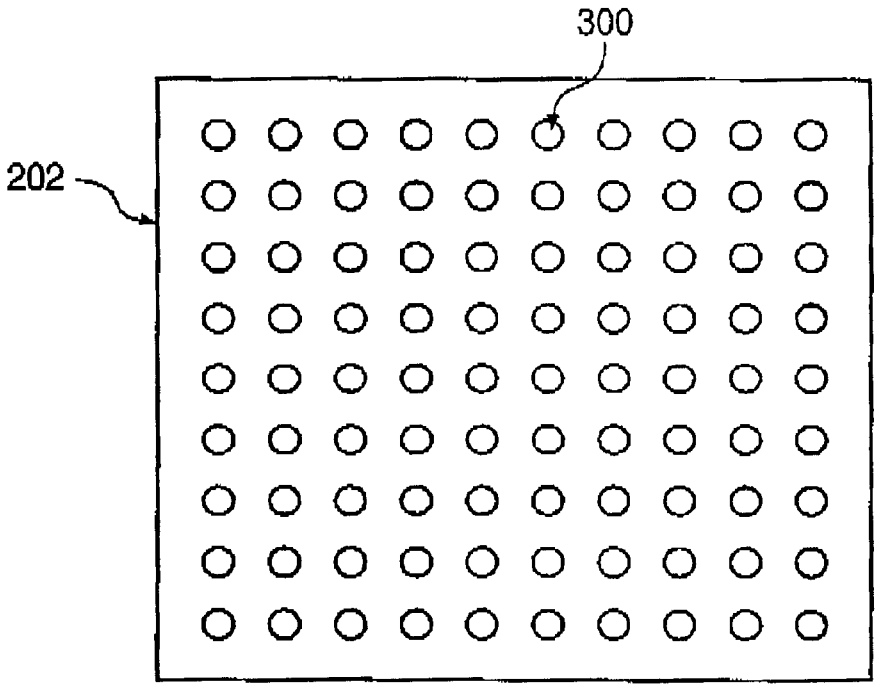
FIG. 3 illustrates detail of a small section of the medium.

FIG. 3 illustrates a close up view of the small section of the medium 202. Dot locations 300 are the locations where ink and/or fixer may be applied to the medium 202. In one embodiment, there are 300 dot locations per inch in both the vertical and horizontal direction of the medium. In this embodiment, the spacing between each dot location 300 is 1/300th of an inch. In other embodiments, there may be 600 or 1200 dot locations per inch. The spacing between the dot locations in these embodiments is 1/600th of an inch and 1/1200th of an inch, respectively.

Depending on the image to be printed, the dot locations 300 may or may not contain drops of ink. A dot location 300 may contain one or more drops of the same color ink and/or may contain drops of ink of different colors thereby producing a wide variety of colors and shades at particular dot locations.

As previously explained with respect to the prior art, applying inks directly to a medium can cause the quality of the print image to degrade. One way these problems have been addressed is by applying fixer to the medium. However, the application of too much or too little fixer can cause other problems such as paper cockle, bleeding or feathering, inconsistent spotsize, poor edge sharpness, and/or poor water and light fastness. Thus, it is important to apply the correct amount of fixer in each dot location.

Dot Locations That Contain Ink

Described below are various techniques that control the amount of fixer applied to each dot location on a medium. This first section describes techniques that control the amount of fixer applied to dot locations which will contain at least one drop of ink. The second section describes techniques that control the amount of fixer applied to dot locations which will contain no drops of ink.

In one embodiment of the invention, the following formula is used to determine the optimal amount of fixer that is to be applied to each dot location. This formula is used for dot locations that will contain at least one drop of ink. The formula shown below assumes that the printing system uses black, cyan, magenta, and yellow inks. It should, however, be appreciated that the formula can be modified to accommodate printing systems that use fewer or more colors.

$$\begin{aligned} \textit{Fixer Amount} = {} & K_{DROPS} * (K_{\text{DROP_WEIGHT}} * K_{\text{FIXER_PERCENT}}) + \\ & C_{DROPS} * (C_{\text{DROP_WEIGHT}} * C_{\text{FIXER_PERCENT}}) + \\ & M_{DROPS} * (M_{\text{DROP_WEIGHT}} * M_{\text{FIXER_PERCENT}}) + \\ & Y_{DROPS} * (Y_{\text{DROP_WEIGHT}} * Y_{\text{FIXER_PERCENT}}) \end{aligned}$$

Fixer amount is the total amount of fixer that should be applied to a dot location. The variables $K_{DROPS}$, $C_{DROPS}$, $M_{DROPS}$, and $Y_{DROPS}$ represent the respective number of drops of black, cyan, magenta, and yellow ink that are to be applied to a dot location. The number of dots that are to be applied to a dot location are derived from source image data. In one embodiment, the source image data is derived from each pixel generated by a computer. This data is typically transformed from RGB data into KCMY data. An example of this process is described in U.S. Pat. No. 5,748,176, assigned to the present assignee and incorporated by reference.

The variables $K_{DROP_WEIGHT}$, $C_{DROP_WEIGHT}$, $M_{DROP_WEIGHT}$, and $Y_{DROP_WEIGHT}$ represent the actual drop weight of black, cyan, magenta, and yellow ink. These drop weights are usually fixed once the particular cartridges are defined, but may vary slightly due to manufacturing variations between the print cartridges. In one embodiment, the drop weight of the black print cartridge ranges between 27–38 nanograms and the drop weight of the color print cartridges ranges between 5–11 nanograms. Ink drop weights are well known in the art. Thus, it is to be appreciated that print cartridges with different drop weights can be used in accordance with the present invention.

The variables $K_{FIXER_PERCENT}$, $C_{FIXER_PERCENT}$, $M_{FIXER_PERCENT}$, and $Y_{FIXER_PERCENT}$ represent a percent of fixer that is to be applied per unit weight of black, cyan, magenta, and yellow ink. Such percentages are usually fixed once the inks and fixer are defined. In one embodiment, the fixer percentage for black ink is approximately ten percent, and the fixer percentage for color inks is approximately seven percent by weight. These variables allow the fixer percentage to be varied for different ink properties, ink drop weights, environmental conditions, or media needs. Further, the fixer percentage for each print cartridge can be varied independently of the other print cartridges.

To illustrate how the formula is used in practice, assume that the source image data for a particular dot location is as follows: 0 drops of black, 2 drops of cyan, 2 drops of magenta, and 1 drop of yellow. Assuming a drop weight of 27 nanograms for black and 7 nanograms for cyan, magenta, and yellow; and a fixer percent of ten percent for black and seven percent for cyan, magenta, and yellow, the actual total fixer amount for that dot location would equal:

$$\begin{aligned} \textit{Fixer Amount} = {} & 0 * (27 * .10) + \\ & 2 * (7 * .07) + \\ & 2 * (7 * .07) + \\ & 1 * (7 * .07) \\ = {} & 2.45 \text{ nanograms} \end{aligned}$$

It will be discussed later how this ideal amount can be approximately reproduced by depositing fixed weight droplets of fixer.

The formula as illustrated above requires eight multiplication operations and three addition operations for each dot location. As a result, determining the fixer amount for each dot location on a single page of paper could take a relatively long time if implemented in software. Accordingly, in one embodiment of the invention, the fixer amount formula is implemented using firmware or hardware as illustrated in FIG. 4.

Figure 4:
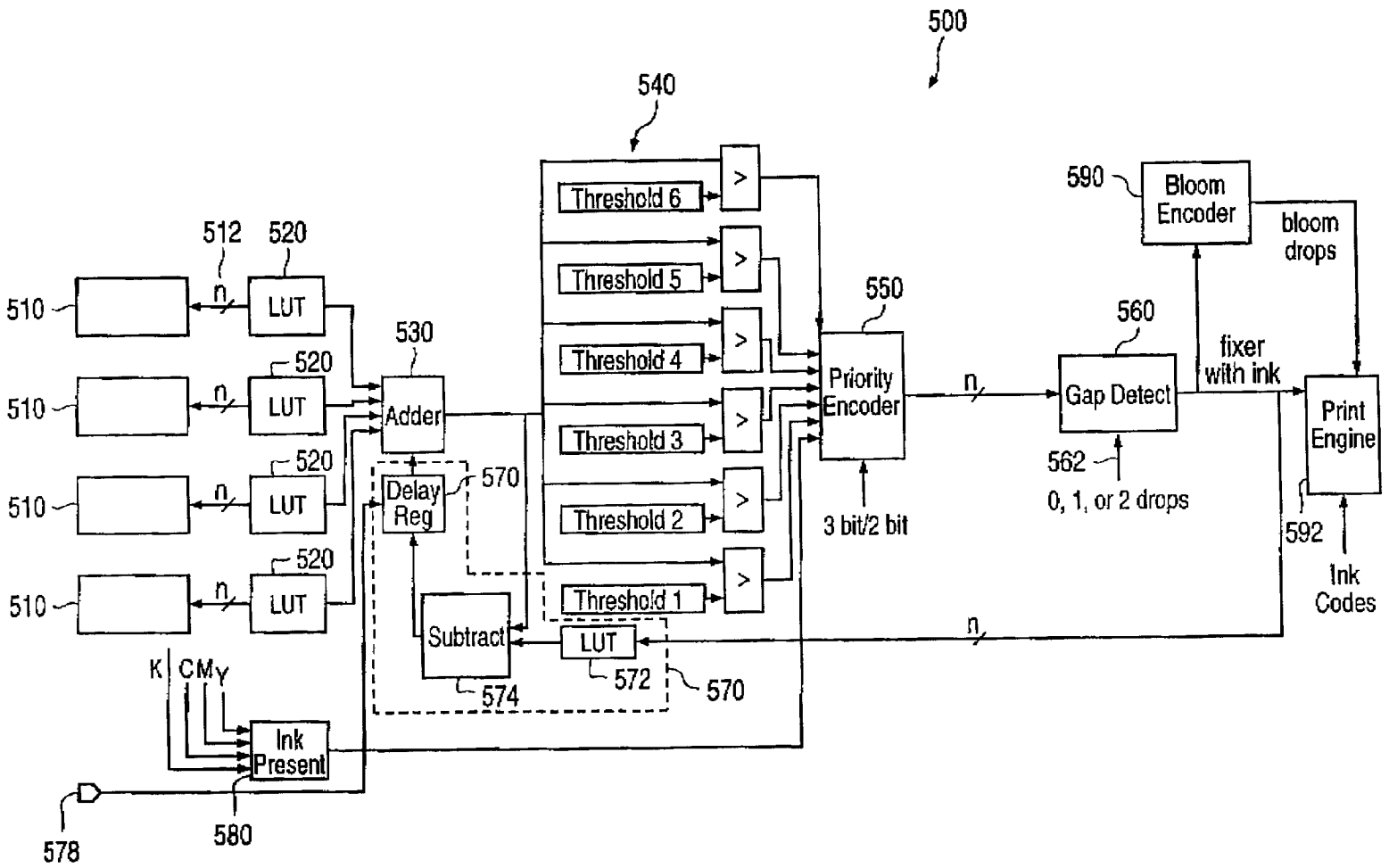
FIG. 4 is a block diagram of a fixer generation circuit in accordance with one embodiment of the invention.

FIG. 4 is a block diagram of a fixer calculation circuit 500. The fixer amount formula is implemented in the fixer calculation circuit 500. In one embodiment, the fixer calculation circuit 500 comprises four look-up tables 520. Each look-up table 520 corresponds to an ink color. For example, one look-up table 520 may correspond to black, one to cyan, one to magenta, and one to yellow ink. Other embodiments may use more or less look-up tables depending upon the number of inks used in the printing system.

The look-up tables 520 are addressed by source image data 510 (which may originate from a computer as described above) through an n-bit address 512. Each n-bit address 512 addresses one of the look-up tables 520. Each n-bit address 512 represents the number of drops of a single color that is to be applied to a single dot location. Referring to the fixer amount formula illustrated above, the four n-bit addresses 512 correspond to the variables $K_{DROPS}$, $C_{DROPS}$, $M_{DROPS}$, and $Y_{DROPS}$. In one embodiment, the n-bit address comprises 3 bits for each table. In other embodiments, the n-bit address can comprise more or fewer than 3 bits for each table depending on the requirements of the particular printing system.

The look-up tables 520 contain values representing the number of drops for a particular color multiplied by the drop weight for that particular color multiplied by the fixer percentage for that particular color. The product equals the optimal amount of fixer for a particular color at a particular dot location. For example, for the black look-up table, the contents of the look-up table will represent the following expression in the fixer amount formula:

$$K_{DROPS}*(K_{DROP_WEIGHT}*K_{FIXER_PERCENT})$$

In one embodiment, the look-up tables 520 are programmable devices such as registers or random access memory (RAM). Thus, if the drop weight of the ink that is being used in the printing system changes, or the fixer percentage changes, the tables can be reprogrammed with the appropriate values. In another embodiment, the fixer amount look-up tables may be hard-coded devices such as read only memory (ROM). This allows the manufacturing cost of the circuit to be reduced at the expense of decreased flexibility.

The outputs of the look-up tables 520 are coupled to an adder circuit 530. The adder circuit 530 can be implemented by techniques well known in the art. The adder circuit 530 produces the sum of the look-up table 520 outputs for a particular dot location. This sum is the optimal amount of fixer for a particular dot location.

The output of the adder circuit 530 is coupled to a threshold detection circuit 540. The threshold detection circuit 540 quantizes the output of the adder circuit 530 into one or more predetermined levels. This is necessary since printing systems typically cannot apply exact amounts of fixer or ink to dot locations but can only apply fixed-weight droplets to a particular dot location. As a result, the actual total amount of fixer must be rounded up or down. This rounding function is performed by the threshold detection circuit 540.

For example, suppose a printing system uses 8 nanogram drops. If the optimal amount of fixer required for a particular dot location (i.e., the output of the adder circuit 530) turns out to be 13.8 nanograms, the actual deposited amount of fixer will have to be rounded up or down. If the threshold detection circuit 540 rounds the amount down, the amount of fixer dropped will be 8 nanograms (1 drop). Alternatively, if the threshold detection circuit 540 rounds the amount up, the amount of fixer dropped will be 16 nanograms (2 drops).

As will be explained below, the average amount identified by the threshold circuit 540 corresponds to the optimal amount of fixer for an area on the medium. The difference between the amount of fixer identified by the threshold circuit 540 for a dot location and the optimal amount of fixer identified by adder 530 is defined as the error amount. In the example above, the error amounts are 5.8 nanograms (13.8–8) and −2.2 nanograms (13.8–16), respectively. The error amount is generated in the error correction circuit 570 discussed below. As mentioned above, the threshold detection circuit 540 may have one or more predetermined levels, and the levels themselves can be spaced apart by any number. For example, the threshold detection circuit 540 may have six levels as illustrated in FIG. 4. Further, the levels may be equally spaced. Threshold 1 may equate to amounts of 0 to >4 nanograms. Threshold 2 may equate to amounts of 4 to >12 nanograms. Threshold 3 may equate to amounts of 12 to >20 nanograms. Threshold 4 may equate to amounts of 20 to >28 nanograms. Threshold 5 may equate to amounts of 28 to >36 nanograms. And threshold 6 may equate to amounts greater than or equal to 36 nanograms. Alternatively, the levels may be arbitrarily spaced. In all cases, however, the threshold detection circuit 540 quantizes the output of the adder circuit 530.

The output of the threshold detection circuit 540 is coupled to a priority encoder circuit 550. The output of an ink present circuit 580 (discussed below) is also coupled to the priority encoder circuit 550. The priority encoder circuit 550 produces an encoded output which is generated in response to the threshold detection circuit 540 outputs and the ink present circuit 580. The encoded output of the priority encoder circuit 550 is n-bits and represents the total amount of fixer that is to be applied to a particular dot location.

The priority encoder can output a 3-bit or 2-bit code, depending on a control signal, as follows:

| 3-Bit Encodings (In Priority) | | |
|---|---|---|
| Threshold 6 | Ink/Fixer Level 6 | 111 |
| Threshold 5 | Ink/Fixer Level 5 | 110 |
| Threshold 4 | Ink/Fixer Level 4 | 101 |
| Threshold 3 | Ink/Fixer Level 3 | 100 |
| Threshold 2 | Ink/Fixer Level 2 | 011 |
| Threshold 1 | Ink/Fixer Level 1 | 010 |
| Ink Present | Ink/No Fixer | 001 |
| Ink Not Present | No Ink/No Fixer | 000 |

The code 000 indicates that ink is not present at the dot location. The code 001 indicates that ink is present at the dot location, but that no fixer is required. This typically occurs when there are very few drops of ink that will be dropped at the dot location. The codes 010, 011, 100, 101, 110, and 111 indicate that ink is present at the dot location, and that fixer is required for the dot location. The 6 different codes correspond to six different amounts of fixer that will be applied to the dot location. The six levels can be defined as any predetermined number of fixer drops.

| 2-Bit Priority Encodings | | |
|---|---|---|
| Threshold 2 | Ink/Fixer High Level | 11 |
| Threshold 1 | Ink/Fixer Low Level | 10 |
| Ink Present | Ink/No Fixer | 01 |
| Ink Not Present | No Ink/No Fixer | 00 |

The code 00 indicates that ink is not present at the dot location. The code 01 indicates that ink is present at the dot location, but that no fixer is required. This typically occurs when there are very few drops of ink that will be dropped at the dot location. The code 10 indicates that ink is present at the dot location, and a "low level" of fixer is required. The code 11 indicates that ink is present at the dot location, and a "high level" of fixer is required. The low level and high level can be defined as any predetermined number of fixer drops.

The coded outputs discussed above are only two examples of codes that can be used in the priority encoder circuit 550. It is to be appreciated that different coding schemes can be used without departing from the spirit and scope of the present invention.

The n-bit coded output of the priority encoder circuit 550 is coupled to the gap detection circuit 560. The purpose of the gap detection circuit 560 is to force the application of a predetermined amount of fixer in situations where ink is required, but no fixer is required. This typically occurs when the number of ink drops to be applied to a dot location is very low. It may, however, be desirable to apply fixer when the encoder circuit 550 produces a code indicating ink but no fixer. To accomplish this, the gap detection circuit 560 detects when the encoder circuit 550 output an ink, but no fixer, code. The gap detection circuit 560 then counts the number of sequential ink, but no fixer, codes outputted by the encoder circuit 550. When the counter equals a predetermined gap number, the gap detection circuit will output a code that will ensure that fixer is applied to that dot location.

The gap can be set to any number (e.g., 0, 1, or 2) using control line 562. If it is set to 0, then every time the encoder circuit outputs an ink, but no fixer code, the gap detection circuit will output a code that will ensure that fixer (e.g., one drop) is applied to that dot location, and the counter is reset. If the counter is set to 2 and the gap detection circuit 560 receives three consecutive ink, but no fixer, codes from the encoder circuit 550, then the gap detection circuit will output a code that will ensure that fixer is applied to that third dot location, and the counter is reset. The gap detection circuit counter is also reset every time it receives an ink and fixer code and every time it receives a no ink and no fixer code.

The output of the gap detection circuit 560 is a coded n-bit representation of the number of drops of fixer that will ultimately be applied to a dot location.

In addition, the output of the gap detection circuit 560 is used as an input to the error correction circuit 570. The error correction circuit 570 comprises an error correction look-up table 572, a subtractor circuit 574, and a delay element 576. The purpose of the error correction circuit 570 is to provide a feedback loop that will compensate for the rounding error caused by the threshold detection circuit 540.

The error correction look-up table 572 converts the coded n-bit representation of the number of drops of fixer that will actually be applied to a dot location into a code that represents the actual amount of fixer applied. The output of table 572, which represents the actual amount of fixer applied, is then fed, along with the adder 530 output, to a subtractor circuit 574.

The subtractor circuit 574 output is the difference between the actual total amount of fixer applied and the optimal amount of fixer for the dot location. This difference is defined as the error amount. In one embodiment, the subtractor circuit 574 has a minimum threshold and a maximum threshold, wherein any error amount below the minimum threshold will be clipped and wherein any error amount above the maximum threshold will be clipped.

The subtractor circuit 574 is coupled to a delay register 576. The delay register delays the output of the subtractor circuit 574 for one dot position cycle. The delayed subtractor circuit 574 output is applied to the adder 530 so that the adder 530 output reflects the outputs of the look-up tables 520 for the current dot position plus an error carried over from the previous dot position.

In one embodiment, the delay register 576 is also coupled to a feedback disable signal 578. The feedback disable signal 578 enables or disables the error correction circuit 570. In other embodiments, the error correction circuit 570 can be disabled using other techniques.

The ink present circuit 580 has four inputs coupled to respective ones of the n-bit inputs of the look-up tables 520. In response to the n-bit inputs, the ink present circuit 580 detects if ink will be applied to a particular dot location. If the source image data indicates that no ink will be applied to a particular ink location, the output of the ink present circuit 580 will indicate to the priority encoder circuit 550 that the present dot location will not contain ink.

The fixer output code is applied to a conventional print engine 592 that also receives conventional ink printing signals. The print engine 592 generates timed control signals for energizing ink/fixer ejection elements for the various printheads in print cartridges 116–126 in FIG. 1.

Dot Locations That Do Not Contain Ink

The description above explained techniques for determining the amount of fixer to apply to a dot location when that particular dot location will contain at least one drop of ink. This section describes techniques that control the amount of fixer applied to dot locations that will not contain ink.

To address problems in the prior art, such as edge sharpness and drop misalignment, it is advantageous to apply fixer to dot locations that are adjacent to or close in proximity to dot locations that will contain at least one drop of ink. Fixer dots adjacent to ink dot locations are defined as bloom dots, and the process of adding bloom dots around an inked region is defined as blooming.

FIG. 5*a* shows a fixer plane with 256 dot locations before blooming. The dot locations that contain the numbers 1, 2, and 3 will contain at least one drop of ink. The dot locations that are empty will contain no drops of ink. The numbers 1, 2, and 3 correspond to the number of drops of fixer that will be dropped at those dot locations. For example, the number 1 may indicate that ink, but no fixer is to be applied at that dot location. The number 2 may indicate that ink and a low level of fixer is to be applied at that dot location. The number 3 may indicate that ink and a high level of fixer is to be applied at that dot location.

FIG. 5*b* shows the fixer plane of FIG. 5*a* after blooming. The dot locations with A's and B's represent bloom dots. The A dots represent a first level of blooming. The B dots represent a second level of blooming. More fixer drops are deposited in the A regions. More or fewer levels of blooming may also be used.

Figure 5C:
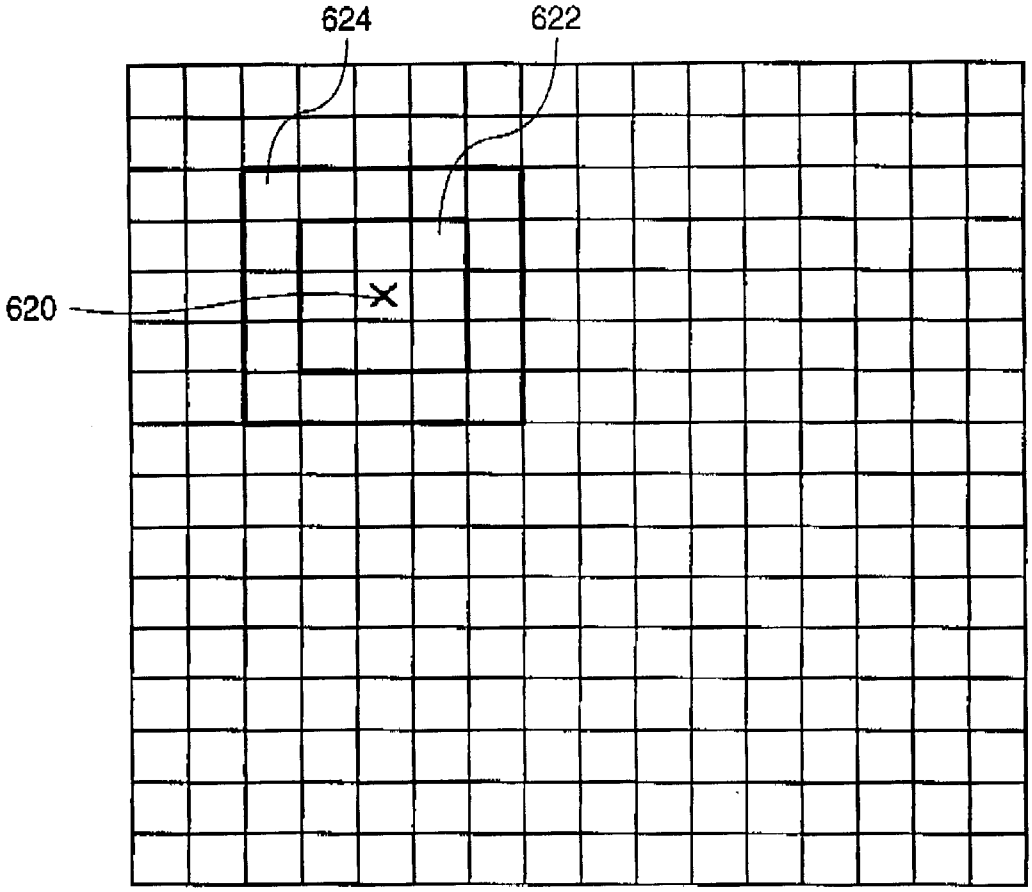
FIG. 5*c* illustrates a target dot, a first bloom level, and a second bloom level in a fixer plane.

One blooming technique follows with reference to FIG. 5*c*. The first step is to determine whether a target dot 620 will contain at least one drop of ink. If the target dot 620 will contain at least one drop of ink, then the circuit of FIG. 4 determines the fixer deposition. If the target dot 620 will not contain a drop of ink, and at least one of the eight dot locations immediately adjacent to the target dot (the level A region 622) will require ink, then the target dot 620 is defined as an A-type bloom dot. This process is applied to each dot location on the fixer plane. For example, if FIG. 5*c* represented the entire fixer plane, this process would have to be applied to all 256 dot locations. After the process is completed, a first level of blooming is defined.

Other levels of blooming may be defined according to the above technique. For example, if the target dot 620 and dots 622 will not contain a drop of ink, and at least one of the sixteen dot locations (the level B region 624) surrounding the A region 622 will require ink, then the target dot 620 is defined as a B-type bloom dot. This technique can be extended to more levels such as a C-type (e.g., three dots away), D-type etc.

In one embodiment, the coded output of the gap detection circuit 560 of FIG. 4 is applied to the bloom encoder 590 in FIG. 4, which contains simple logic and registers to perform the blooming process and identify the level of fixer to be deposited for a particular dot position. One skilled in the art will readily be able to select the appropriate logic gates to perform the simple logic discussed with respect to FIG. 5*c*.

As discussed above, in connection with 2-bit priority encoding, the code 00 indicates that ink is not present for a particular dot location. The codes 01, 10, and 11 indicate that ink is present for a particular dot location. Thus, using the process described above, if the target dot 620 contains a code of 01, 10, or 11 (i.e., at least one drop of ink), no blooming is done. If the target dot 620 contains a code of 00 (i.e., no ink) and at least one of the eight surrounding dot locations contains a code of 01, 10, or 11 (i.e., at least one drop of ink), then the target dot 620 is defined as an A-type bloom dot.

In some situations, it may be advantageous to deplete the number of bloom dots defined by the process described above to achieve, on average, the desired bloom amount. For example, suppose the printing system uses 4 nanogram drops of fixer. Since the drops are relatively small, it may be desirable to bloom without depletion. By contrast, suppose the printing system uses 8 nanogram drops. Here, since the drops are twice as large as in the previous example, it may be desirable to use 50% depletion by depositing only one fixer drop for every two A or B bloom dot locations. The larger drops will tend to spread greater distances across the medium and therefore produce the same fixer coverage as a system that deposits one or more 4 nanogram drops in each bloom location.

FIG. 5*d* shows a 4×4 fifty percent depletion bloom mask 628 with sixteen depletion bits 629 and the corresponding bloomed fixer plane 630. Half of the depletion bits are set to "1", which will cause the corresponding bloom dots to be depleted (canceled). The other half of the depletion bits are set to "0" which will not cause the corresponding bloom dots to be depleted. The 4×4 mask is tiled onto the fixer plane so that the pattern in the 4×4 mask is applied to all of the bloom dot locations on the fixer plane. The corresponding bloomed fixer plane 630 after depletion is illustrated in the lower half of FIG. 5*d*. Any bloom mask can be used with any arrangement of 0's and 1's.

The bloom mask can be incorporated into the bloom encoder 590 in FIG. 4. The bloom encoder 590 may be programmable to change the bloom mask and any level of bloom depending on the type of inks, fixer, or medium used or depending on other factors, such as humidity. Furthermore, different type bloom dots (e.g., A-type and B-type) may have independent bloom masks or generate a unique number of bloom drops.

The embodiments described herein may be implemented in software, hardware, or a combination of both.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

We claim:

1. A system for use by an inkjet printer, said system receiving ink printing data, said system comprising:

a fixer amount generation circuit receiving said data, said circuit calculating a variable amount of fixer to be applied to a location on a medium depending on a quantity of ink to be applied to said medium as expressed by said printing data.

2. The system of claim 1 wherein the fixer amount generation circuit comprises a threshold circuit for determining an amount of fixer to be applied to each said location on the medium.

3. The system of claim 1 wherein the fixer amount generation circuit, comprises:

one or more fixer amount look-up tables;

an adder circuit having inputs coupled to said one or more look-up tables; and a threshold detection circuit having inputs coupled to an output of said adder circuit.

4. The system of claim 3 wherein an output of the adder circuit is representative of a substantially optimum amount of fixer that is to be applied to said location on the medium.

5. The system of claim 3 wherein the threshold detection circuit quantizes the output of the adder circuit into two or more levels.

6. The system of claim 3 further comprising:

an encoder coupled to the threshold detection circuit for outputting a binary value identifying fixer to be applied to said location.

7. The system of claim 6 wherein the encoder output represents the amount of fixer to be applied to the medium at a particular location.

8. A system for use by an inkjet printer, said system receiving ink printing data, said system comprising:

a fixer amount generation circuit receiving said data, said circuit calculating a variable amount of fixer to be applied to a location on a medium depending on a quantity of ink applied to said medium, the fixer amount generation circuit including one or more fixer amount look-up tables and including an adder circuit having inputs coupled to said one or more look-up tables and including a threshold detection circuit having inputs coupled to an output of said adder circuit, said one or more look-up tables performing a multiply function.

9. A system for use by an inkjet printer, said system receiving ink printing data, said system comprising:

a fixer amount generation circuit receiving said data, said circuit calculating a variable amount of fixer to be applied to a location on a medium depending on a quantity of ink applied to said medium; and an error correction circuit including a subtraction circuit for subtracting a value corresponding to a deposited fixer amount from a substantially optimum fixer amount to obtain an error value and including a delay element coupled to the subtraction circuit for providing said error value to a calculated fixer amount for a next location on said medium.

10. The system of claim 9 wherein the subtraction circuit outputs the difference between a value output from an adder circuit connected to said one or more look-up tables and said value corresponding to said deposited fixer amount.

11. A system for use by an inkjet printer, said system receiving ink printing data, said system comprising:

a fixer amount generation circuit receiving said data, said circuit calculating a variable amount of fixer to be applied to a location on a medium depending on a quantity of ink applied to said medium; and a bloom generation circuit for applying bloom, wherein bloom is defined as fixer applied to locations on said medium where no ink is to be applied.

12. The system of claim 11 wherein said bloom is applied in locations that are a predetermined distance from locations on said medium where ink is to be applied.

13. The system of claim 12 wherein the bloom generation circuit further comprises a bloom depletion mask for depleting bloom in predetermined locations on said medium.

14. A system for applying fixer to a medium in an inkjet printer comprising:

one or more look-up tables receiving ink printing data, wherein said one or more look-up tables determine an amount of fixer to be applied to the medium;

an adder coupled to the one or more look-up tables, said adder outputting a value corresponding to a substantially optimum amount of fixer to be applied to the medium;

a threshold detection circuit coupled to the adder for quantizing said value output from said adder; and an error correction circuit connected to said adder for supplying a fixer amount error value to said adder.

15. The system of claim 14 wherein the one or more look-up tables comprises at least four look-up tables corresponding to at least the colors black, cyan, magenta, and yellow.

16. The system of claim 14 wherein the threshold detection circuit converts the desired amount of fixer into one of a plurality of discrete levels.

17. The system of claim 14 further comprising an encoder connected to the threshold circuit, wherein the encoder produces values identifying the presence of ink in a location as well as fixer.

18. The system of claim 17 wherein the encoder is controlled to output a 2 bit or 3 bit value.

19. The system of claim 17, further comprising a gap detection circuit coupled to said encoder, wherein the gap detection circuit forces the application of fixer after a certain number of locations without fixer.

20. The system of claim 17, wherein the encoder values provide an input into the error correction circuit.

21. The system of claim 17, further comprising a bloom generation circuit for applying bloom, wherein bloom is defined as fixer applied to locations on said medium where no ink is to be applied.

22. The system of claim 21, wherein the bloom generation circuit further comprises a bloom depletion mask for depleting bloom in predetermined locations on said medium.

23. A method for controlling application of a fixer in an inkjet printer, comprising:

receiving image data;

determining a substantially optimal amount of the fixer in response to a quantity of ink as expressed by the image data; and applying a quantized amount of the fixer to a medium.

24. The method of claim 23, further comprising:

detecting a certain number of consecutive dot locations wherein no fixer is applied; and applying a predetermined amount of fixer when said certain number of consecutive dot locations wherein no fixer is applied has been detected.

25. The method of claim 23 wherein said determining a substantially optimum amount of the fixer in response to the image data comprises:

determining dot locations where no ink is to be applied;

applying fixer in a predetermined portion of the dot locations where no ink is to be applied if the dot locations are within a predetermined distance from an ink dot location.

26. A method for controlling application of a fixer in an inkjet printer, comprising:

receiving image data;

determining a substantially optimal amount of the fixer in response to the image data; and applying a quantized amount of the fixer to a medium, wherein determining a substantially optimal amount of the fixer includes addressing one or more look-up tables and includes adding outputs of the one or more look-up tables to an error value to produce said substantially optimal amount of fixer to be applied to the medium.

27. The method of claim 26, wherein said error value is generated by subtracting said quantized amount of the fixer from the substantially optimal amount of the fixer.

28. A method for controlling application of a fixer in an inkjet printer, comprising:

receiving image data;

determining a substantially optimal amount of the fixer in response to the image data;

applying a quantized amount of the fixer to a medium; and depositing an amount of fixer on said medium where no ink is to be printed to reduce blooming.

29. A method for applying fixer to a medium in an inkjet printer comprising:

receiving image data;

determining from the image data each dot location that will contain at least one drop of ink;

calculating an amount of fixer to be applied to dot locations that will contain at least one drop of ink;

determining from said image data each dot location that will not contain any drops of ink but is within a predetermined distance from each dot location that will contain at least one drop of ink;

applying fixer to at least some dot locations that will contain at least one drop of ink; and applying fixer to at least some dot locations that will not contain any drops of ink but are within said predetermined distance from each dot location that will contain at least one drop of ink.

* * * * *